US009518416B2

(12) United States Patent
Pacini

(10) Patent No.: US 9,518,416 B2
(45) Date of Patent: Dec. 13, 2016

(54) PURELY ROTATIONAL CASEMENT WINDOW

(71) Applicant: FAPIM S.P.A., Altopascio (IT)

(72) Inventor: Sergio Pacini, Montecarlo (IT)

(73) Assignee: FAPIM S.P.A., Altopascio (Lucca) (IT)

( * ) Notice: Subject to any disclaimer, the term of this patent is extended or adjusted under 35 U.S.C. 154(b) by 0 days.

(21) Appl. No.: 14/783,683

(22) PCT Filed: Apr. 4, 2014

(86) PCT No.: PCT/IB2014/060434

§ 371 (c)(1),
(2) Date: Oct. 9, 2015

(87) PCT Pub. No.: WO2014/170789

PCT Pub. Date: Oct. 23, 2014

(65) Prior Publication Data

US 2016/0060938 A1 Mar. 3, 2016

(30) Foreign Application Priority Data

Apr. 16, 2013 (IT) ..... FI2013A0084

(51) Int. Cl.

| | |
|---|---|
| ***E05F 11/10*** | (2006.01) |
| ***E06B 3/32*** | (2006.01) |
| ***E06B 3/36*** | (2006.01) |
| ***E05F 11/24*** | (2006.01) |

(52) U.S. Cl.

CPC ..... *E05F 11/10* (2013.01); *E05F 11/24* (2013.01); *E06B 3/325* (2013.01); *E06B 3/36* (2013.01)

(58) Field of Classification Search

CPC ..... E05F 11/10; E05F 11/24; E05F 11/16; E06B 3/36; E06B 3/325; E05Y 2900/148

See application file for complete search history.

(56) References Cited

U.S. PATENT DOCUMENTS

| | | | | |
|---|---|---|---|---|
| 7,396,054 | B2 * | 7/2008 | Carrier | E05B 17/0025 292/302 |
| 7,464,619 | B2 | 12/2008 | Vetter | |
| 2005/0016073 | A1 * | 1/2005 | Petta | E05C 9/02 49/504 |
| 2012/0174487 | A1 * | 7/2012 | Lambertini | E05F 11/16 49/353 |
| 2013/0025207 | A1 * | 1/2013 | Lambertini | E05C 9/063 49/300 |
| 2015/0013230 | A1 * | 1/2015 | Balbo Di Vinadio | E05D 15/44 49/359 |

(Continued)

FOREIGN PATENT DOCUMENTS

| | | |
|---|---|---|
| CN | 101131061 | 2/2008 |
| DE | 681093 | 9/1939 |

(Continued)

OTHER PUBLICATIONS

International Search Report based on International Application No. PCT/IB2014/060434.

*Primary Examiner* — Justin Rephann
(74) *Attorney, Agent, or Firm* — Lucas & Mercanti, LLP

(57) ABSTRACT

The present invention regards a casement window, and more in particular it is directed to a casement window with controlled opening and the possibility of locking the hung sash in open position, to prevent the inadvertent return of the hung sash.

15 Claims, 8 Drawing Sheets

(56) References Cited

U.S. PATENT DOCUMENTS

| | | | | |
|---|---|---|---|---|
| 2015/0128498 | A1* | 5/2015 | Morton | E05F 11/16 49/67 |
| 2016/0130847 | A1* | 5/2016 | Gramstad | E05C 9/1833 49/394 |

FOREIGN PATENT DOCUMENTS

| | | |
|---|---|---|
| DE | 1708449 | 5/1971 |
| DE | 8908958 | 9/1989 |
| GB | 2183723 | 6/1987 |
| WO | 2011036639 | 3/2011 |

* cited by examiner

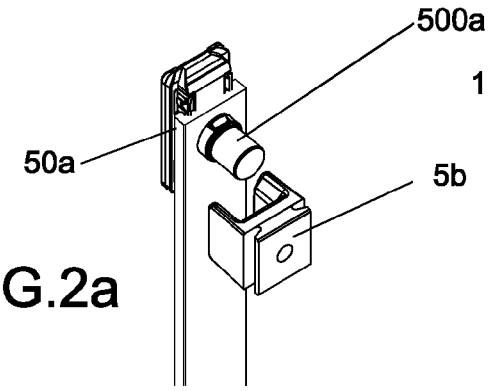
FIG.2a
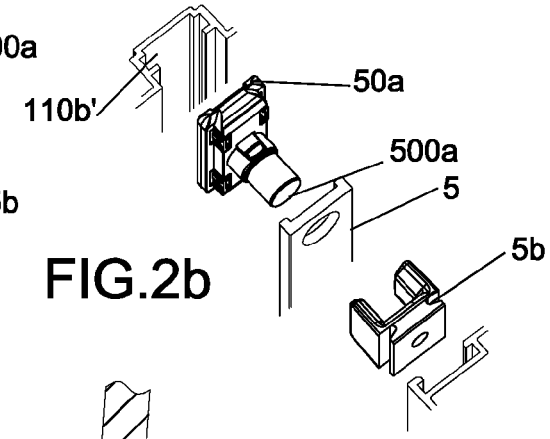
FIG.2b
FIG.3b
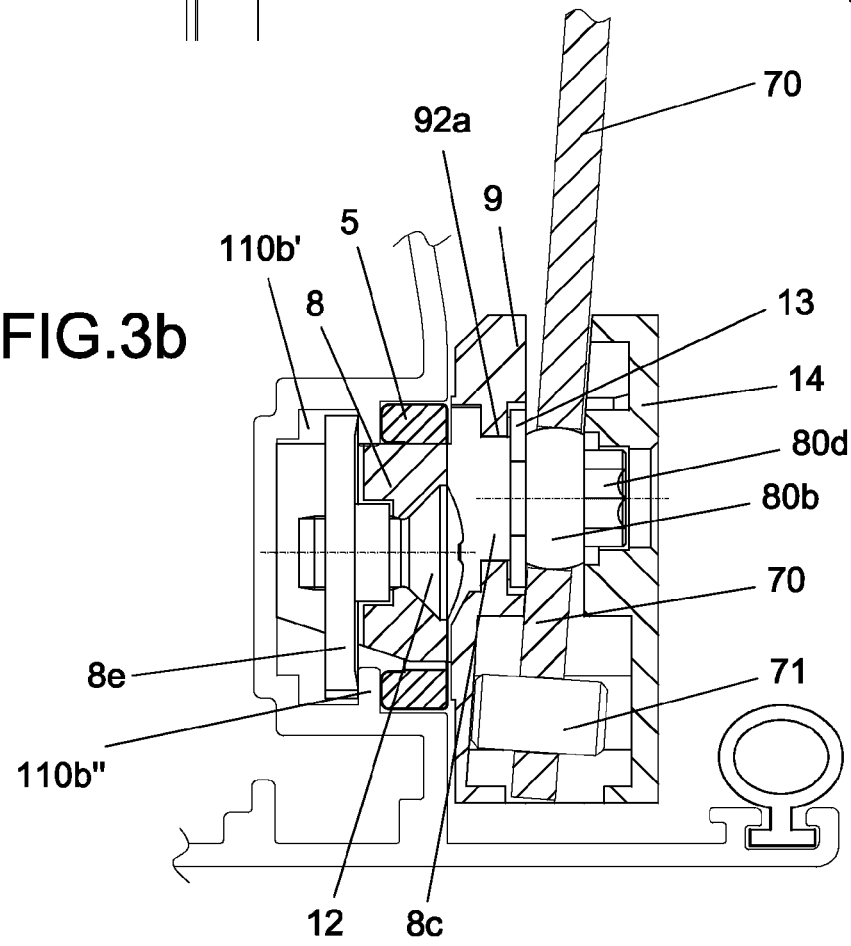

22
21c
21
72
2
21
72
22
7
6
5
4
1

3
21a
2

PURELY ROTATIONAL CASEMENT WINDOW

CROSS-REFERENCE TO RELATED APPLICATIONS

This application is a 371 of PCT/IB2014/060434, filed Apr. 4, 2014, which claims the benefit of Italian Patent Application No. FI2013A000084, filed Apr. 16, 2013.

TECHNICAL FIELD OF THE INVENTION

The present invention relates to a casement window with controlled opening and possibility of locking the hung sash in open position, so as to avoid the accidental closing thereof. It also encompasses a mounting kit for realizing such a window.

BACKGROUND OF THE INVENTION

This type of casings is commonly used for the aeration of environments and it is associated, on the inner part, to nets or mosquito nets. Considering the frequent use in multi-storey buildings, such as skyscrapers, these casings are subject to constraining safety requirements. In particular, it is required that the hung sash opens in a controlled manner (i.e. it is not subject to abrupt opening due, for example, to sudden wind blows) and that it has a limited displacement angle away from the fixed frame (so as to not allow people to lean out therefrom). In addition, it is required that, once at maximum opening position, the hung sash is permanently locked, so that it cannot close accidentally (again, for example, due to sudden wind blows).

Some examples of window casings like the one described above are known. International patent publication WO2011/036639 discloses a casing which provides a fixed frame and a hung sash which opens with respect to it. The casing can be opened by means of a handle, whose first rotation determines the unlocking of the hung sash, while a second and subsequent rotation determines the opening displacement thereof. The hung sash is connected to the fixed frame by means of articulation devices which allow for the hung sash to have a roto-translation movement with respect to the fixed frame. Further in detail, the devices allow for a roto-translation along top and lower crosspieces of, respectively, the hung sash and the fixed frame, about a vertical axis so that—in the opening position—the hung sash becomes spaced apart from the fixed frame also at the jamb closest to the articulation devices, towards the outside of the room in which the casing is mounted.

The opening and the locking of the hung sash in open position is assisted by a driving arm connected to the handle by means of a kinematic pair made up of a variable pitch rack and by a relative pinion, also of the variable pitch type. The pinion and rack engagement, not only permits the controlled opening of the hung sash but it also prevents for an accidental movement of the arm when completely open (thus preventing the inadvertent locking of the hung sash).

The casing as described has a complex construction, hence is quite expensive in terms of manufacturing. Besides, the structural complexity makes the casing poorly adaptable to be used with conventional and standard solutions such as for example rotational hinges of the traditional kind. Moreover, the opening system applied to the casing of WO2011/036639 is not adapted to be used on very heavy casings; indeed, the articulation devices used in such casing have a limited load capacity and the number thereof cannot be increased (with the aim of distributing the load) when the weight to be supported increases.

Further examples are known from patents CN101131061 and U.S. Pat. No. 7,464,619. In both documents, devices for the manual opening of a hung sash are described, comprising a manoeuvre lever which uses, for driving the movement of the hung sash, a gear mechanism which prevents the accidental closing of the hung sash from the opening position.

Also document GB2183723 describes an opening system which makes use of a gear mechanism of the pinion/rack type. The latter is connected to a crank handle which, under the manual actuation of a user, drives the gear mechanism for the actuation of a pantograph linkage which opens the window.

Further examples of similar known devices are disclosed by German publications DE1708449 and DE681093.

Generally speaking, all the aforementioned further examples are in turn structurally complex and expensive from a productive point of view. The actuation is troublesome and uncomfortable for the user, in comparison with a conventional window, i.e. a window having a traditional opening using a handle which, besides to being more comfortable to grip and easy to use, it would be more appreciated by the user also from an aesthetical standpoint.

SUMMARY OF THE INVENTION

Thus, an object of the present invention is to overcome the drawbacks shown by the currently known casings. In particular, an object of the present invention is to provide a device for the opening and/or the closing of a casing in a casement window, and casing itself, that can be cost-effectively produced and has a simple construction, namely making use of components that are standard and easy to find on the market.

More generally, an object of the present invention is to provide a casement of the above mentioned type, representing an effective construction alternative to what is currently known.

These and other objects are attained by casing according to the invention, whose essential features are defined by the attached independent claim. Further important characteristics are defined by the dependent claims.

BRIEF DESCRIPTION OF THE DRAWINGS

The characteristics and advantages of the casing according to the present invention shall become apparent from the description that follows of an embodiment thereof provided by way of non-limiting example with reference to the attached drawings wherein:

FIG. 2*a* is an enlarged view of a detail of the locking/unlocking means of FIG. 2 while the FIG. 2*b* is an exploded view of FIG. 2*a;*

FIG. 3*b* is an enlargement of a detail of the FIG. 3, representing however with a cut-away view of parts that were not sectioned in FIG. 3, so as to better show means for opening/closing the hung sash and in particular the connection thereof to the fixed frame;

DETAILED DESCRIPTION OF THE INVENTION

Figure 1:
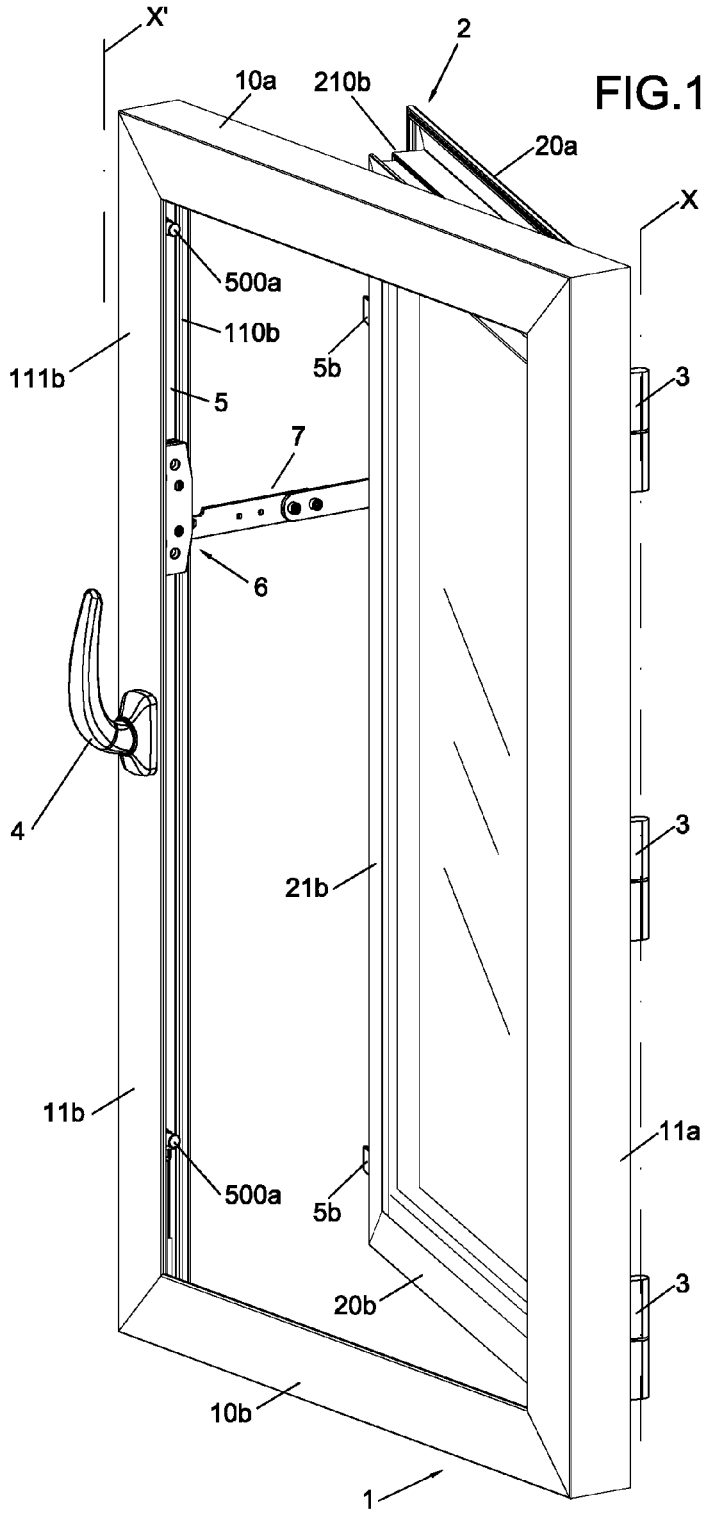
FIG. 1 shows, in a perspective and isolated view, a casing according to the invention with a hung sash in maximum opening position.
Figure 2:
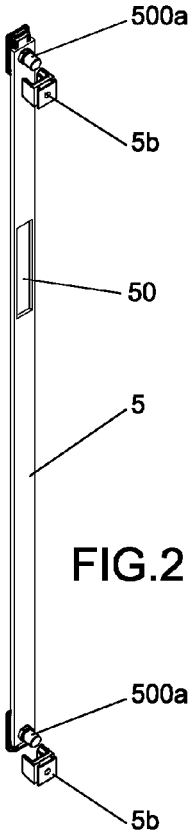
FIG. 2 shows in isolation means for locking/unlocking the hung sash with respect to the fixed frame.

In the present description, for the sake of clarity, the terms "vertical" and "horizontal" refer to the ground surface and hence to a typical working configuration of the casing mounted on a wall raising from the ground in which the hung sash opens with respect to the fixed frame according to a rotation movement around an axis perpendicular to the ground surface. The development in height of the hung sash corresponds to a direction referred to as "longitudinal", while the width development corresponds to a "transversal" direction. Similarly, also the terms "lower" and "upper" are used with reference to the ground surface, for indicating elements which are, respectively, closer thereto or more distant therefrom. However, these indications are not to be considered limitative, being it clear that the casing according to the invention can have different spatial orientations (e.g. the one of a yawn window).

More in detail, with reference to the aforementioned figure, the casing according to the invention comprises a fixed frame 1 adapted to be mounted in an aperture formed in a wall (for example the perimeter wall of a building) to which a hung sash 2 is pivotly connected by means of hinges 3 of the known type. The hinges 3 allow the rotation of the hung sash 2 about an axis X defined by the hinges and perpendicular to the ground surface, when the casing is in use.

In particular, the fixed frame 1 is defined by hollow profiles (usually aluminium, but also wood, plastic, etc) mounted to form a rectangular framework, with sides parallel two by two. Two crosspieces are arranged horizontally, one of which 10*a* is at the top and one 10*b* at a lower side and two jambs arranged vertically of which a first jamb 11*a* and a second jamb 11*b*. The first jamb 11*a* is the one along which a hinging of the hung sash 2 is obtained by means of the hinges 3 about the axis X, while the second jamb 11*b* is the one along which the locking and the opening of the hung sash is obtained. The second jamb 11*b* runs according to a longitudinal axis X' which is clearly parallel with X.

Similarly, also the hung sash 2 is obtained by profiles which define two horizontal crosspieces, one 20*a* at the top and one 20*b* at the lower part respectively, and two vertical uprights, of which a first upright 21*a* is the one for connection with the hinges 3, and a second upright 21*b* which is the one along which the locking and the opening of the hung sash 2 is obtained.

On the second jamb 11*b* of the fixed frame a lateral face 110*b* is also identified which, when the casing is in a closed arrangement, becomes side by side with a respective lateral face 210*b* of the second upright of the hung sash 2.

A handle 4 is mounted on an inner face 111*b* of the second jamb 11*b* (i.e. the face towards the indoor room of the environment in which the casing is mounted). Starting from a closed arrangement of the casing, (as explained more in detail hereafter), the handle allows first for the unlocking of the hung sash with respect to the frame, and then the opening thereof.

The handle 4 is operatively connected to a control rod 5 which on the second jamb 11*b* is slidably placed on the lateral face 110*b* so as to slide along the longitudinal axis X'. In fact, on the lateral face 110*b* a longitudinal groove 110*b*' is formed which runs over the entire length of the jamb and in which sliders 50*a* are slidably engaged, the sliders having, for such purpose, suitable ribs complementary with the groove. Each slider is integral with the rod 5 so as to obtain the slidable connection between the jamb and the rod. The fixing between the sliders and the rod is obtained by means of respective protrusions 500*a* which penetrate suitable holes formed at mutually opposite ends of the rod so as to project beyond a front face of the rod. A spring locking system of the known type (thus not described in detail) prevents the protrusions from disengaging from the respective holes. In order to obtain the locking of the hung sash in the closed position, the two protrusions 500*a* become engaged with respective retaining members 5*b* fixed on the second upright 21*b* of the movable hung sash, and in particular on the lateral face 210*b* thereof.

In the closed casing configuration the rod 5 is in a locking position i.e. in a position such that each protrusion 500*a* is engaged with the corresponding retaining member 5*b*. Due to such engagement, the hung sash is prevented from opening. To a rotation of the handle of 90° responds a translation according to the axis of the rod 5 upwards, until an unlocking position is reached, i.e. a position of disengagement of each protrusions 500*a* from the respective retaining member 5*b*, thus allowing the opening of the hung sash.

Particular reference shall be made now to figures from 4 to 8. Means 6 for opening/closing the hung sash are operatively linked with the rod 5. Such means are in turn operatively connected to an arm 7 capable, through a rotational movement, of driving the opening or closing of the hung sash in a controlled manner. To this purpose, the arm 7 is slidably connected at its mutually opposite ends thereof respectively to the aforementioned opening/closing means 6 and to the hung sash 2.

In further detail, the opening/closing means 6 comprise a fixed element 8 fixed to the second jamb 11*b*. This fixed element is locked in the longitudinal groove 110*b*', projecting with respect to the lateral face 110*b;* hence, on the rod 3 an aperture 50 for the passage and the housing of the fixed element is also formed. Moreover, the fixed element supports a pin 80 to which the arm 7, and in particular a first or lower end 70 thereof, is pivotally connected.

Besides to the fixed element 8, the opening/closing means 6 comprise a movable element 9 slidable on the fixed element 8 and integral with the rod 5 (so as to be driven thereby in a translation with respect to the fixed element). The movable element 9 is precisely engaged, without clearances, in the aperture 50 by means of coupling teeth 90*a*, 90*b*.

Besides being engaged with the fixed element, the lower end 70 of the arm, is linked with the movable element. In particular, on the movable element 9 a slot 91 is formed having a vertical or longitudinal 91*a* straight segment arranged parallel to the axis X' and thus according to the sliding direction of the rod 5. From at least one of the ends of the vertical straight segment, at least one horizontal diverging segment 91*b* extends, preferably a straight or transversal segment (thus arranged orthogonally with respect to the axis X') which is joined with the longitudinal straight segment via a bend 91*c*. In the described example there are two transversal straight segments, so that the slot is C-shaped, with the concavity facing towards the inside of the room environment and thus opposite with respect to the opening side of the hung sash.

Figure 6:
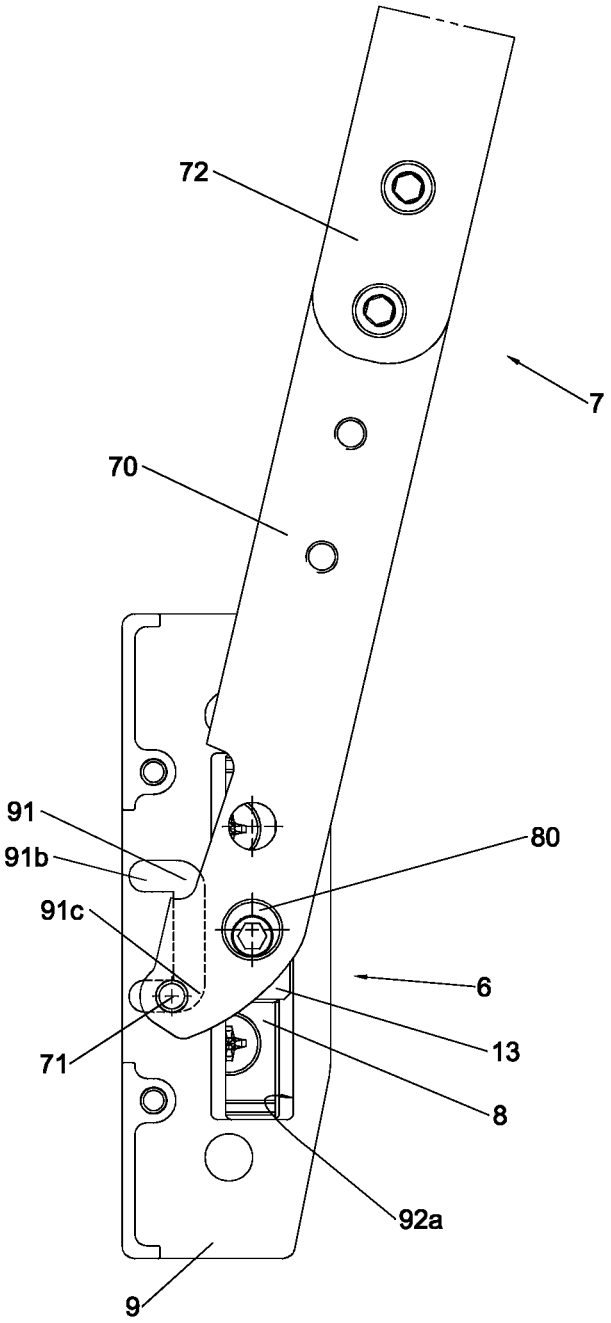
FIG. 6 shows the opening/closing means and the opening arm of FIG. 5 in an opening step of the hung sash.

A peg 71 of the arm is slidably and rotatably engaged in the slot 91. The peg projects from the arm 7 at the lower end 70 thereof, in proximity and beneath the pin 80. With reference to FIG. 6, the slot 91 and the pin 80 are at positions that are both transversely and longitudinally staggered or misaligned with respect to each other.

Figure 5:
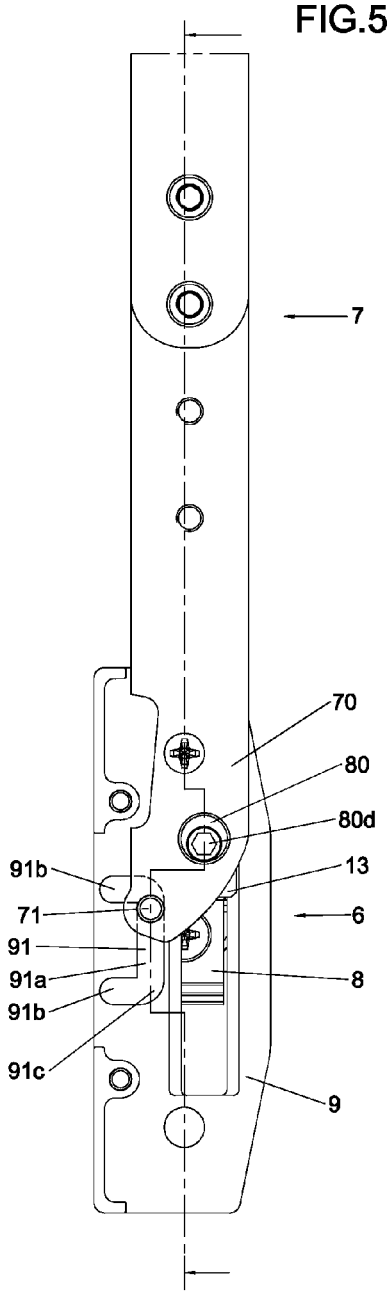
FIG. 5 is a front view (with a covering element omitted for the sake of greater clarity) of the aforementioned opening/closing means of the casing operatively connected to the aforementioned opening arm, the latter being represented in the position corresponding to the closed hung sash.

The above is sufficient to understand the basing casing operation, which is detailed as follows. With reference to FIG. 5, in the closed casing arrangement the rod 5 is completely lowered so that the protrusions 500*a* are engaged in the respective retaining members 5*b*. Furthermore, in such position the movable element 9 (and in particular an upper coupling tooth 90*a*) abuts on a top shoulder 81 of the fixed element 8. The arm 7 in the closing configuration is instead in a substantially vertical rest position i.e. arranged parallel with respect to the axis X'.

Starting from such closed arrangement of the casing, in order to open the hung sash 2, a user must firstly rotate the handle 4 by 90°. Such first rotation causes a first translation of the rod 5 upwards and the unlocking of the hung sash 2 as mentioned above. At the same time, the upwards translation of the rod 5 drives the movable element 9 with respect to the fixed element 8 causing the sliding of the slot 91 with respect to the peg 71 over the entire length of the vertical straight segment 91*a*. During this movement the arm is still stationary in the rest position.

A second rotation of the handle 4 by further 90° produces the further translation of the rod 5 (and hence of the movable element 9) beyond the unlocking position until an abutment of the peg 71 on the bend 91*c* is reached. In this way, the arm 7 starts rotating around the pin 80 (as shown in FIG. 6) driving the controlled opening of the hung sash 2.

Figure 7:
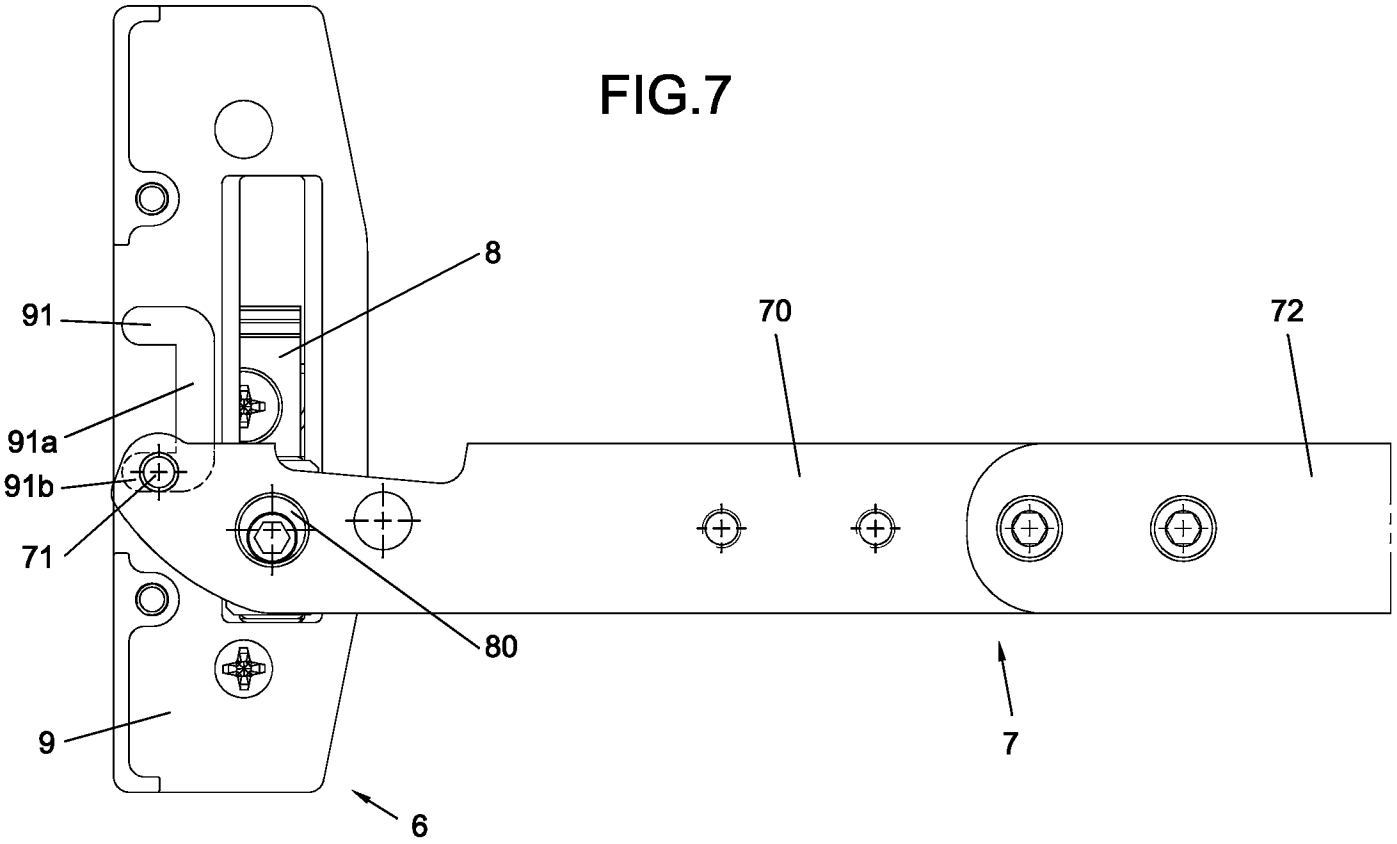
FIG. 7 shows the opening/closing means and the opening arm in the position corresponding to the hung sash completely open, with the arm arranged horizontally (i.e. parallel to the ground surface)

The translation of the rod 5 and the simultaneous rotation of the arm 7 causes the sliding of the peg 71 within the horizontal straight segment 91*b* up to the end thereof, corresponding to a stop of the run. In such a position (FIG. 7), corresponding to that of maximum opening of the hung sash 2, the arm is arranged crosswise with respect to the axis X', in particular as in this embodiment in a horizontal configuration or orthogonal with X', and the movable element 9 (and in particular a lower coupling tooth 90*b*) abuts on a lower shoulder 82 of the fixed element 8.

The positioning of the peg 71 at the end stop and the abutment of the movable element on the lower shoulder of the fixed element leads to a rigid locking of the hung sash 2 in the maximum opening position so as to efficiently prevent the accidental closure of the hung sash. In addition, being the handle is provided with snap locks of the known type, the rod 5 is prevented from moving inadvertently, with further contribution to the stable positioning of the hung sash 2.

The aperture 50 formed in the rod 5 has a longitudinal extension suitable to allow for the entire translation run of the rod (corresponding to all the 180° of rotation of the handle 4), without the same rod interfering with the fixed element 8.

Closing the hung sash requires rotating the handle in the reverse direction; thus, the rod 5 shall slide in the opposite direction, i.e. downwards, firstly causing the reverse rotation of the arm 7 from the horizontal position up to the vertical position with simultaneous drive of controlled closing of the hung sash 2. Secondly, the further downward sliding of the rod causes the engagement of the protrusions 500*a* in the respective retaining members, leading to the locking of the hung sash in the closing position.

Figures 3, 3A:
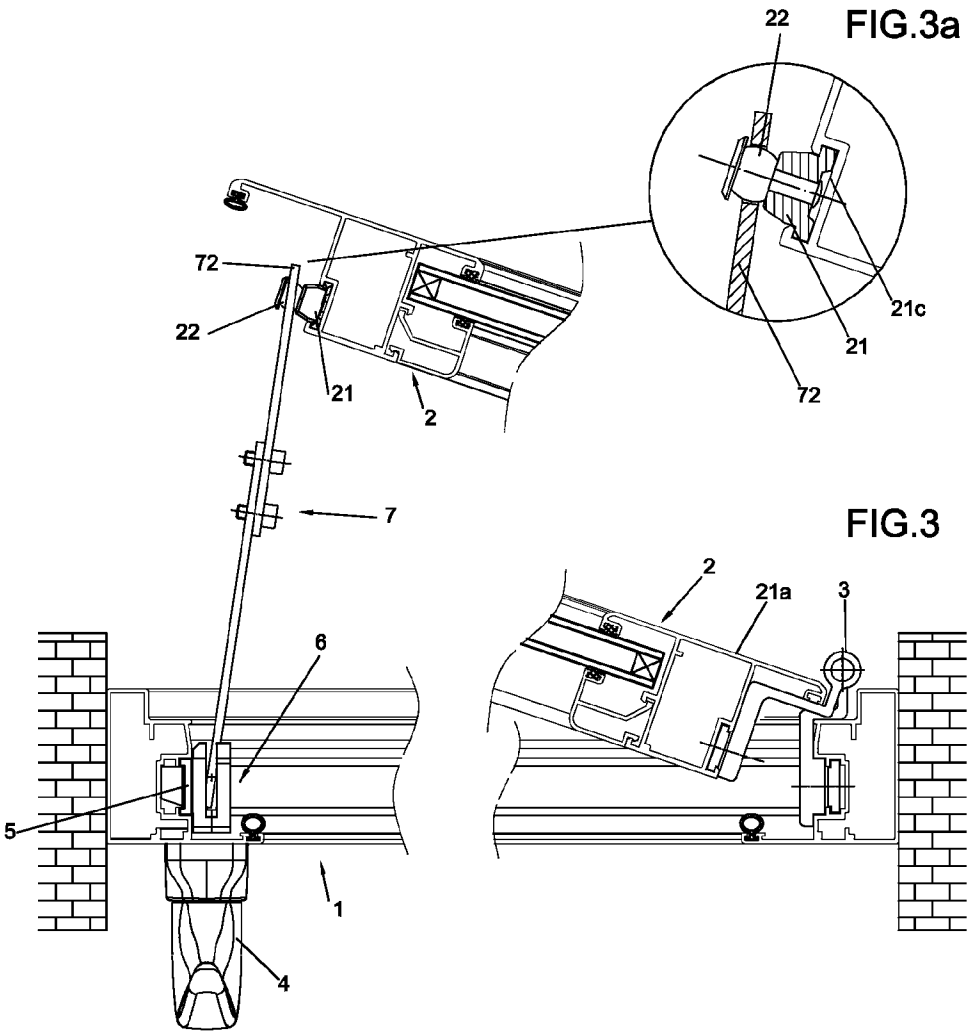
FIG. 3 shows a cross section (i.e. according to a plane parallel to the ground surface, when the casing is mounted) of the casing of the previous figures, the casing in this case being mounted on a wall, again with the hung sash in maximum opening position.
FIG. 3*a* is an enlargement of an end of an opening arm connected to the hung sash by means of a spherical coupling, shown in sectional view.
Figure 8:
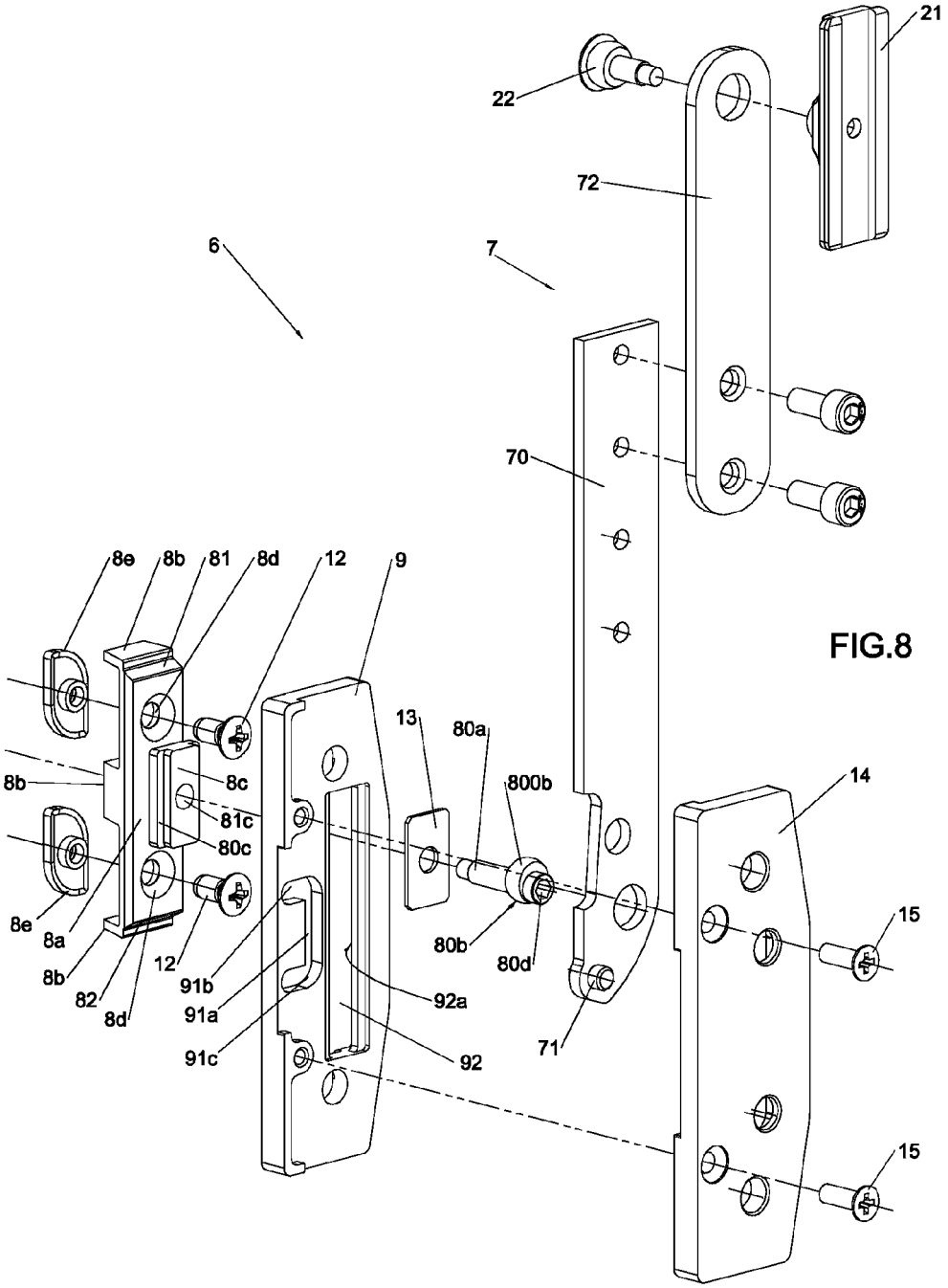
FIG. 8 is an exploded view of the opening/closing means of the hung sash in which a covering element omitted in the previous figures is also visible.
Figure 9:
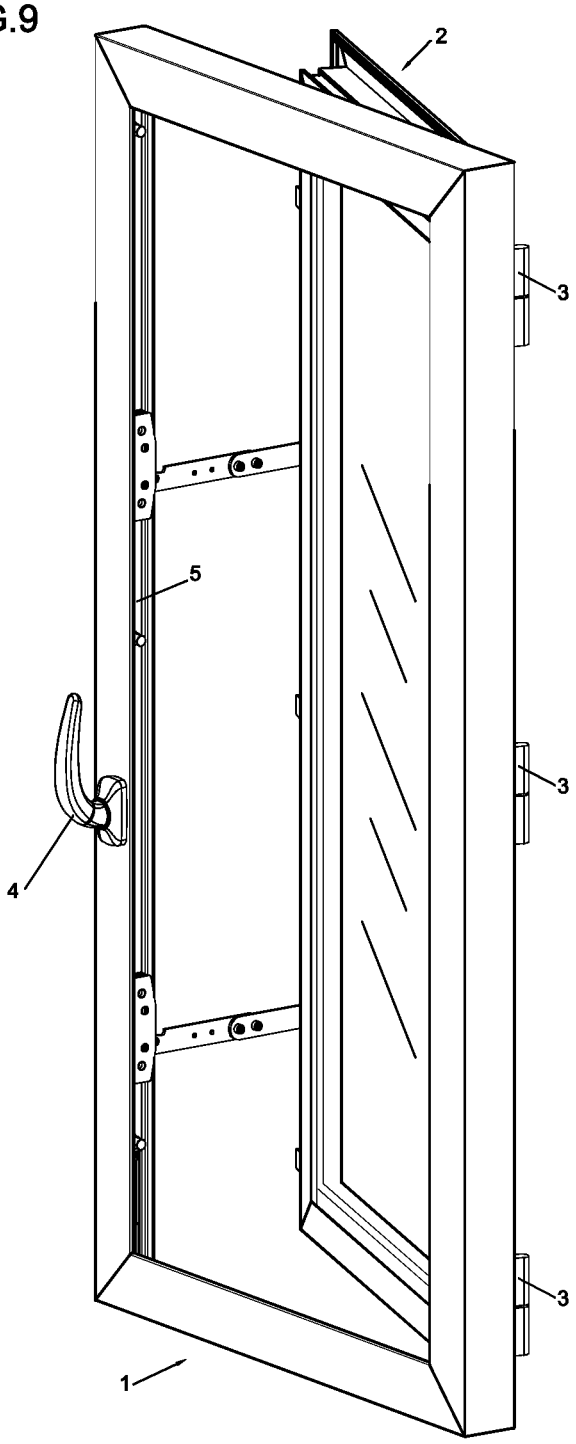
FIG. 9 shows a variant of the casing having in this case two groups of the aforementioned opening/closing means, as well as a respective number of opening arms.

This clarified, a more detailed overview of the construction solutions in connection with some aspects of the invention will now be provided, also and particularly with reference to FIG. 8. The fixed element 8 comprises a substantially rectangular plate-like body 8*a* with two opposite main faces. Feet 8*b* for the stable resting of the element in the groove 110*b*', and a parallelepiped-shaped projection 8*c* adapted to slidably engage with the movable element 9 extend from either main face of the fixed element. Aside the projection 8*c*, on the body 8*a*, holes 8*d* are formed for allowing the introduction of screws 12 coupling the element 8 to the jamb. According to a preferred embodiment, the screws are engaged with elongated, cam shaped counter-plates 8*e*. The counter plates assist a stable positioning of the fixed element 8 in the aforementioned groove 110*b*' of the jamb of the fixed frame; indeed, as observable also from FIG. 3*b*, by fastening the screws on the counter-plates, these rotate in the space left free between the feet 8*b*, becoming arranged crosswise in the groove so as to come in abutment with lips 110*b*" which partially shut the aperture of the groove. As the counter-plates 8*e* become tightened on the lips 110*b*", a stable mounting of the fixed element 8 is attained.

On a flat surface of the projection 8*c*, a hole 81*c* is formed for the insertion of the pin 80. The parallelepiped-shaped projection 8*c* also has step-like grooves 80*c* on the sides.

The movable element 9 is in turn substantially rectangular-shaped and plate-like, with greater dimensions with respect to the fixed element. On the movable element 9, with the aforementioned slot 91, a strip-like channel 92 is formed running in a vertical direction. At the long sides of the channel 92, ribs 92*a* project towards the inside of the same, for matching with the step-like grooves 80*c* (when, clearly, the movable and the fixed element are mutually coupled). The mutual locking between the movable element and the fixed element is obtained through a plate 13 which is held in an abutment position above the ribs 92*a* by the pin 80 and in particular by an enlarged portion 80*b* thereof. In this way, the plate 13 forms, with the step-like grooves 80*c*, a guide system within which the ribs 92*a* are free to slide, in response to the movement of the rod 5.

The pin 80 has a stem 80*a* on which the enlarged portion 80*b* is obtained eccentrically with respect to the same stem. The stem 80*a* has a length sufficient to penetrate the hole 81*c* of the fixed element, thus allowing for a stable locking of the pin 80. The enlarged portion is instead disk-shaped with a spheroidal peripheral surface 800*b*. As apparent from the drawing, the arm 7 is engaged on the enlarged portion 80*b* and in particular around its spheroidal peripheral surface 800*b*. The engagement between the arm and the spheroidal peripheral surface is indeed akin to a ball joint. Such a kind of engagement is also carried out on a second end 72 of the arm 7, which is connected to the second upright 21*b* of the hung sash 2 by means of a clasp 21 with spheroidal head 22. As mentioned, the relevant end of the arm 7 is slidably linked with the hung sash, and to this purpose the clasp 21 is free to slide inside a groove 21*c* suitably obtained along the second upright, so as to assist the movement of opening or closing of the sash.

Figure 4:
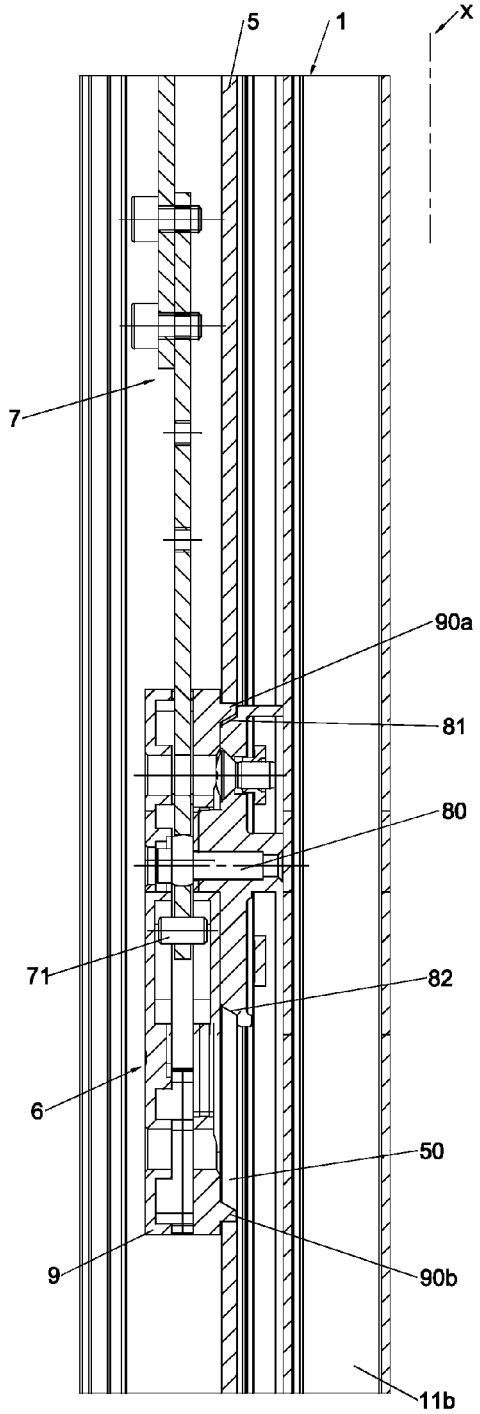
FIG. 4 shows in longitudinal section (i.e. with respect to a plane perpendicular to the ground surface, with the casing in the mounted arrangement), the casing with hung sash in the closing position; in addition, the aforementioned locking/unlocking means can be observed operatively connected to the opening/closing means of the hung sash.

As a consequence, the arm 7 shall be free to adapt to the movement of opening of the hung sash 2, thus also being able to move in misalignment with respect to the axis of the pin 80 defined by the stem 80*a*, as shown in FIG. 4.

The head of the pin 80 provides for a slot 80*d* for the introduction of an adjustment instrument such as an Allen wrench (not shown). In this way, the pin can be rotated to vary the positioning of the enlarged portion, hence adjusting the position of the arm in the vertical rest configuration and allowing for the recovery of any machining clearances or positioning errors.

The movable element 9 is protected by a covering member 14 mounted thereon by means of threaded means such as screws 15. Besides protecting the opening/closing means against infiltration of dirt or moisture, such member also serves an aesthetic function. The covering member 14 has—on a face intended to abut with the movable element 9—a C-shaped slot (not visible in the figures) analogous to the slot 91 so that the peg 71, during actuation, is moved within and constrained by both slots. This allows reducing the wear of the contact surfaces.

Finally, according to a preferred solution that is obvious as such, the arm is obtained as two segments connected to each other (FIG. 8).

The casing according to the invention reaches all the aforementioned objects. In particular, it can be surely noted that all the components that serve to the drive of the hung sash can in this case be arranged without requiring heavy and/or complex interventions on the profiles which define the fixed frame and hung sash. Indeed, all the components can be fixed to the profiles by means of simple threaded elements, thus with considerably savings in terms of manufacturing costs and times. This result is specially due to the particular ball joint-like constraint system between the arm 7 and the fixed element 8 of the means 6 for opening/closing the hung sash.

In addition, the casing uses absolutely conventional and traditional rotation hinges, with high reduction of production costs. The use of such hinges also allows for the casing according to the invention to be used for applications which require large dimensions and thus high load, given that the number of hinges may be multiplied up to attaining a number of hinges suitable to sustain the weight of the hung sash.

A casing with rightwards opening has been described. However, for inverting the opening direction (i.e. leftwards), it will be sufficient to invert the direction of rotation of the arm, overturning it. It is also clear that the invention encompasses the device when provided in a mounting kit intended for realizing a casing as described and including at least the means 5 for locking or unlocking the hung sash 2, at least one arm 7 and the opening or closing means 6.

Figure 10:
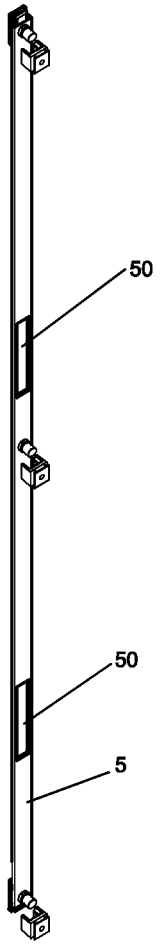
FIG. 10 represents in isolation the means for locking/unlocking the hung sash of FIG. 9.

Casings with a plurality of opening/closing means, and thus two or more arms can also be provided. For example, FIG. 10 shows a casing with two opening arms controlled by respective groups of the aforementioned opening/locking means. It is obvious that the rod 5 shall have a suitable number of apertures 50, as shown in FIG. 11. This variant is particularly suitable in case of windows of great dimensions and high weight, for opposing to the wind action, which may cause the hung sash to suffer a warp. In addition, further points for locking the hung sash can also be applied, possibly at a central position, by adding retaining members 5*b* and protrusions 500*a*.

The present invention has been described with reference to the preferred embodiments. It should be understood that there can be other embodiments falling within the same inventive concept, as defined by the scope of protection of the following claims.

The invention claimed is:

1. A window casing comprising:

a fixed frame comprising a first jamb and a second jamb;

a movable hung sash pivotally connected to said fixed frame by means of hinges which define at said first jamb a rotation axis (X) of the hung sash with respect to the frame, said second jamb running along a longitudinal axis (X') parallel with said rotation axis (X);

means for locking or unlocking the hung sash with respect to the frame, slidable according to said longitudinal axis (X') on the frame between a first position, or locking position, at which said locking or unlocking means engage with the hung sash to prevent the opening thereof, and a second position, or unlocking position, at which said locking or unlocking means disengage from the hung sash to allow the opening thereof;

a handle mounted on the frame and operatively connected to the locking or unlocking means;

at least one arm arranged between the second jamb and the hung sash, adapted to move between a closing configuration substantially parallel to said longitudinal axis (X') and an opening configuration substantially crosswise with said longitudinal axis (X');

for each arm, opening or closing means adapted to drive the arm between said opening configuration and said closing configuration, this implying the consequent opening or closing of the hung sash with respect to the frame;

said locking or unlocking means being further operatively connected to said opening and closing means so as to control the actuation of the arm following a sliding beyond said unlocking position;

said opening or closing means comprising a fixed element integral with said frame and a movable element integral with said locking or unlocking means, adapted to translate with respect to said fixed element along said longitudinal axis (X');

a first end of the arm being pivotally engaged in a constraint on said fixed element, as well as pivotally and slidably engaged with a slot on said movable element;

said slot having a longitudinal segment parallel to the longitudinal axis (X') and at least one crosswise segment diverging from said longitudinal axis (X');

wherein additionally said slot and said constraint on said fixed element are misaligned both in the direction of said longitudinal axis (X') and in the direction transversal thereto, thus to a first rotation of said handle and an ensuing first translation of said locking or unlocking means up to said unlocking position, the arm is kept engaged with said longitudinal segment of said slot in configuration parallel to the longitudinal axis (X'), while at a second rotation of said handle and an ensuing second translation of said locking and unlocking means beyond said unlocking position, the arm is pushed towards said opening configuration for a controlled opening of said hung sash due to the slidable engagement with said at least one crosswise segment of the slot, and vice versa; and said constraint on said fixed element providing a spheroidal peripheral surface on which the arm is engaged thereto in a ball joint arrangement.

2. The casing according to claim 1, wherein said constraint comprises a pin having a stem on which an enlarged portion is formed with said spheroidal peripheral surface.

3. The casing according to claim 2, wherein said enlarged portion is arranged eccentrically with respect to an axis of said stem, a slot being formed at the head of said pin for the introduction of a tool for adjusting the position of said enlarged portion and hence the position of said arm in said closing configuration.

4. The casing according to claim 1, wherein said locking or unlocking means comprise a control rod slidable along said longitudinal axis (X') under the control of said handle, said rod having ends provided with protrusions adapted to become engaged with retaining members integral with said movable hung sash, in said locking position each projection being engaged with the corresponding retaining member, a translation of said rod leading to the disengagement of each protrusion from the respective retaining member.

5. The casing according to claim 4, wherein said rod comprises sliders supporting said protrusions and slidably guided by a groove formed in said second jamb.

6. The casing according to claim 5, wherein said fixed element is fixed in said groove so as to be projecting with respect to it, an aperture being formed in said rod in correspondence with said fixed element, said movable element being engaged within said aperture by means of coupling teeth.

7. The casing according to claim 6, wherein said fixed element comprises a projection which is slidably engaged within a channel formed in said movable element, said pin being associated to said projection.

8. The casing according to claim 7, wherein said projection has sides on which step-like grooves are formed, for matching with ribs formed at the sides of said channel projecting towards the inside of the same, the mutual coupling between said movable element and said fixed element being completed through a plate which is held in an abutment position on the ribs by said enlarged portion of said pin, the plate thus forming, with each step-like groove, a guide system within which the ribs are free to slide, in response to the translation of said rod.

9. The casing according to claim 1, wherein a second end of said arm is connected to said hung sash by means of a coupling member with a spheroidal head associated to said sash, said coupling member being free to slide in a groove formed along a free upright of said hung sash.

10. The casing according to claim 9, wherein said handle is associated to an inner face of said second jamb, said handle providing a movement with snap lock positioning.

11. The casing according to claim 1, wherein the engagement between said arm and said movable element is obtained by means of a peg integral with said arm which is engaged slidably and pivotly in said slot.

12. The casing according to claim 11, wherein said slot is C-shaped, with concavity faced in opposite direction with respect to the direction of opening of the hung sash, said slot providing bend joints between each crosswise segment and said longitudinal segment.

13. The casing according to claim 1, wherein said first rotation and said second rotation of said handle corresponds to successive 90° rotations.

14. The casing according to claim 13, wherein said movable element is associated to a covering element which is provided on a face abutting with said movable element with a slot analogous to said slot, said peg engaging with both said slots.

15. A mounting kit for realizing the window casing according to claim 1 comprising:

said means for locking or unlocking the hung sash;

said at least one arm; and said opening or closing means.

* * * * *